US011426742B2

(12) United States Patent
Myers et al.

(10) Patent No.: US 11,426,742 B2
(45) Date of Patent: Aug. 30, 2022

(54) SPRAY NOZZLE

(71) Applicant: Delavan Inc., West Des Moines, IA (US)

(72) Inventors: Steve J. Myers, Norwalk, IA (US); Philip E. O. Buelow, West Des Moines, IA (US); Robert R. Fogarty, West Des Moines, IA (US)

(73) Assignee: Collins Engine Nozzles, Inc., Des Moines, IA (US)

( * ) Notice: Subject to any disclaimer, the term of this patent is extended or adjusted under 35 U.S.C. 154(b) by 226 days.

(21) Appl. No.: 16/774,844

(22) Filed: Jan. 28, 2020

(65) Prior Publication Data

US 2021/0229117 A1 Jul. 29, 2021

(51) Int. Cl.
*B05B 1/34* (2006.01)

(52) U.S. Cl.
CPC ..... *B05B 1/3447* (2013.01); *B05B 1/3468* (2013.01)

(58) Field of Classification Search
CPC ..... B05B 1/3447; B05B 1/3468
See application file for complete search history.

(56) References Cited

U.S. PATENT DOCUMENTS 2,526,220 A 10/1950 Goddard
4,474,331 A * 10/1984 Aprea ..... B05B 1/3447 239/488
5,697,553 A * 12/1997 Stotts ..... B05B 1/3442 239/406
5,738,282 A 4/1998 Grogan
7,926,744 B2 4/2011 Thomson et al.
8,347,631 B2 1/2013 Bailey
8,579,213 B2 * 11/2013 Myers ..... B05B 1/06 239/492
9,625,146 B2 * 4/2017 Myers ..... B05B 7/10
2020/0139390 A1 * 5/2020 Thomson ..... B05B 7/065

FOREIGN PATENT DOCUMENTS

EP 2527042 A2 11/2012

OTHER PUBLICATIONS

Extended European search report issued in corresponding EP application No. 21153991.1, dated Jun. 24, 2021.

* cited by examiner

*Primary Examiner* — Ryan A Reis
(74) *Attorney, Agent, or Firm* — Locke Lord LLP; Joshua L. Jones; Scott D. Wofsy

(57) ABSTRACT

A spray nozzle comprising a housing including a primary passage defining a primary axis, a series of secondary passages configured to provide swirl to a fluid passing therethrough circumferentially positioned around the housing, a series of standoffs circumferentially spread around an outer surface of the housing and located downstream along the primary axis of the series of swirling passages, wherein each of the swirling passages corresponds to a respective standoff of the series of standoffs, in order to control the swirl of the fluid.

15 Claims, 3 Drawing Sheets

SPRAY NOZZLE

BACKGROUND

Technological Field

The present disclosure relates to a spray nozzle, and more particularly to a swirling spray nozzle.

Description of Related Art

A variety of devices are known in the nozzle art for controlling various characteristics of spray emanating from spray nozzles. Certain features have been used in fluid circuits to provide a desired spray angle without imparting spray slot streaks, however the conventional methods and systems may become unsatisfactory for their intended purpose as the fluid circuit moves radially outward, farther away from the centerline of the nozzle. Thus, there is still a need in the art for a spray nozzle having improved streak and angle control. There also remains a need in the art for such nozzles and components that are economically viable. The present disclosure may provide a solution for at least one of these remaining challenges.

SUMMARY OF THE INVENTION

A spray nozzle including a housing having a primary passage defining a primary axis, a series of secondary passages configured to provide swirl to a fluid passing there through, circumferentially positioned around the housing, a series of standoffs circumferentially spread around an outer surface of the housing and located downstream along the primary axis of the series of swirling passages, wherein each of the swirling passages corresponds to a respective standoff of the series of standoffs, in order to control the swirl of the fluid. The outer surface of the housing can include multiple outer diameters as a function of position along the primary axis. Each of the standoffs can be circular and include a rounded face facing the corresponding secondary passage.

Each of the secondary passages can define a secondary axis not parallel to the primary axis and be directed at a corresponding standoff. The series of secondary passages can be positioned radially outward from the outer surface of the housing.

Each of the standoffs can be positioned downstream of the series of secondary passages along the primary axis of the primary passage. A distance between each of the standoffs can greater than a diameter of each of the standoffs.

An outer sleeve covering the nozzle is configured to be part of an assembly. A top surface of each of the standoff can be flush against an inner surface of the outer sleeve to maintain concentricity of the nozzle components. A flow path can provided between the outer surface of the nozzle and the inner surface of the sleeve, for receiving fluid exiting the secondary passages.

Feeding a fluid stream through the primary passage of the nozzle along a primary axis, producing a swirling fluid stream through the series of secondary passages along, at a non-parallel angle to the primary axis, can reduce the swirl of the fluid by impinging the fluid against the series of standoffs downstream of the secondary passages. The resultant spray includes at least a 80 degree angle and no greater than 110 degrees.

These and other features of the systems and methods of the subject disclosure will become more readily apparent to those skilled in the art from the following detailed description of the preferred embodiments taken in conjunction with the drawings.

BRIEF DESCRIPTION OF THE DRAWINGS

So that those skilled in the art to which the subject invention appertains will readily understand how to make and use the devices and methods of the subject invention without undue experimentation, preferred embodiments thereof will be described in detail herein below with reference to certain figures, wherein.

DETAILED DESCRIPTION

Figure 1:
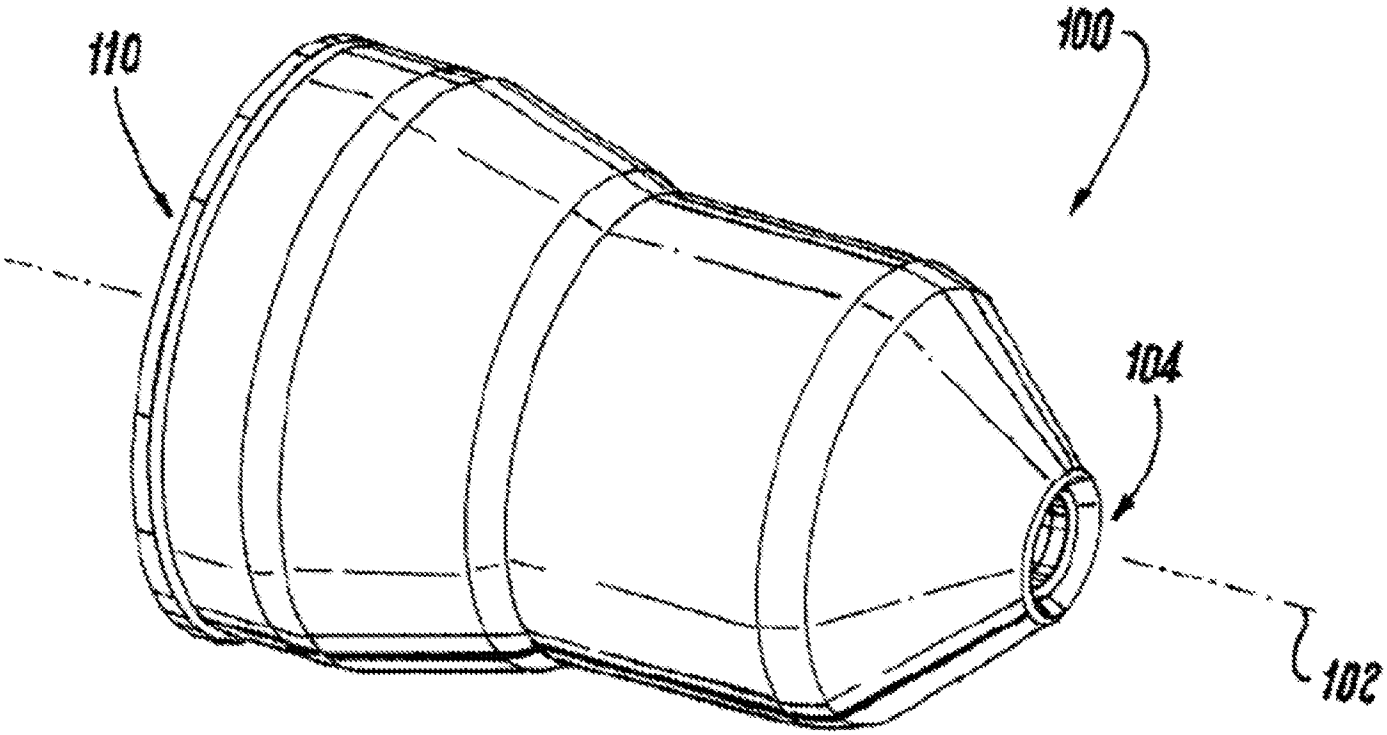
FIG. 1 is a perspective view of a nozzle assembly.

Reference will now be made to the drawings wherein like reference numerals identify similar structural features or aspects of the subject invention. For purposes of explanation and illustration, and not limitation, a partial view of an exemplary embodiment of a nozzle assembly in accordance with the invention is shown in FIG. 1 and is designated generally by reference character 100. Other embodiments of the nozzle assembly in accordance with the invention, or aspects thereof, are provided in FIGS. 2-3, as will be described. The methods and systems of the invention can be used to control a resultant spray and spray angle from the nozzle.

Figure 2:
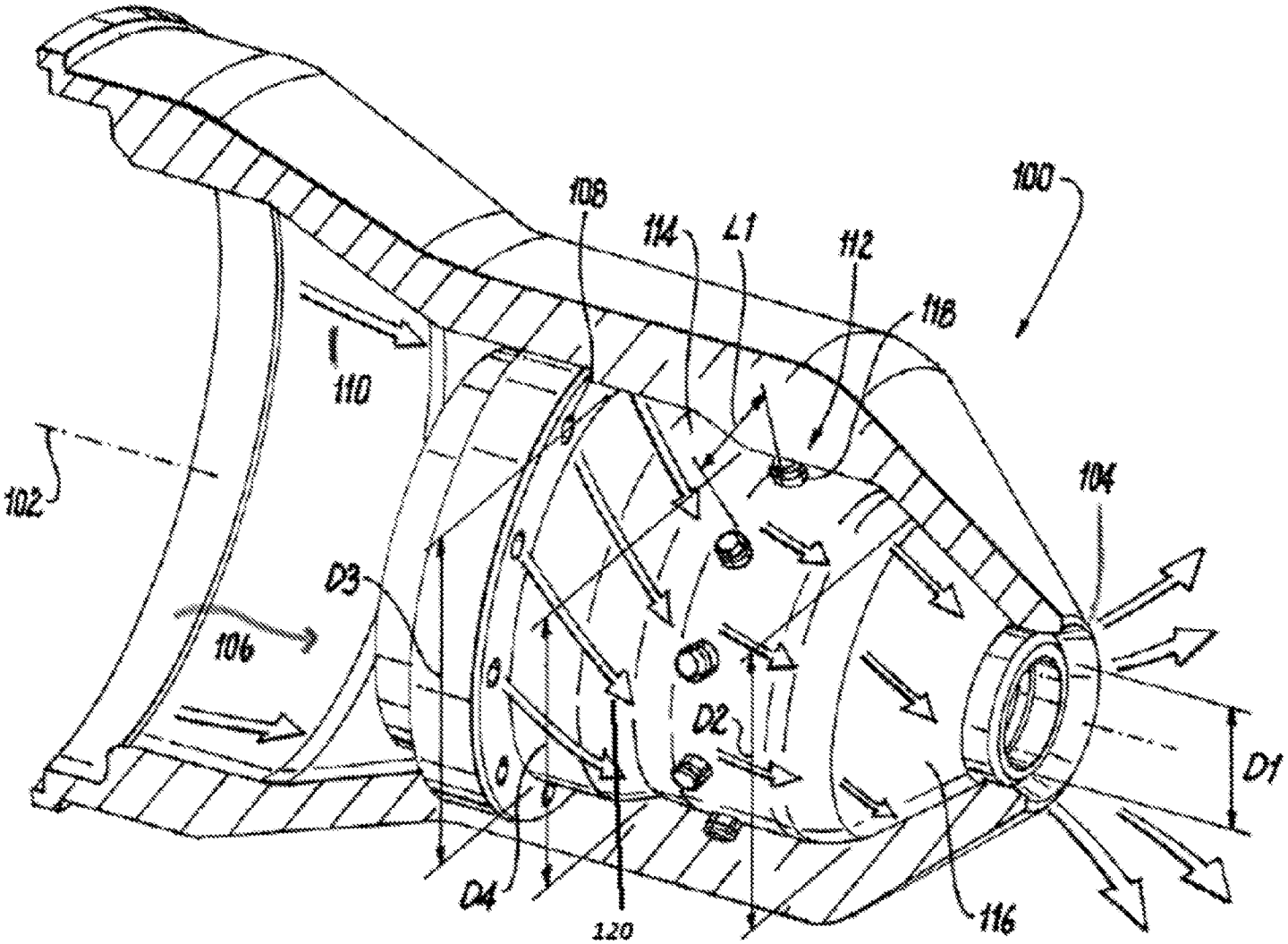
FIG. 2 is a side of view of FIG. 1, showing the cut away of an internal nozzle.

FIG. 1 shows a nozzle assembly 100 including a housing (on the inside, shown in FIG. 2) including a primary passage 106 defining a primary axis 102. FIG. 2 shows the spray nozzle housing 116 including a primary passage 106, a series of secondary passages 108 configured to provide swirl to a fluid 110 passing there through circumferentially positioned around the housing 116, a series of standoffs 112 circumferentially spread an outer surface 114 of the housing 116 and located downstream along the primary axis 102 of the series of swirling passages 108, wherein each of the swirling passages 108 corresponds to a respective standoff 112 of the series of standoffs in order to control the swirl of the fluid 110. Each of the standoffs includes a rounded face 118 facing the corresponding secondary passage 108 and is circular. The rounded faces 118 help control, direct, and reduce the swirl of the fluid 110 that comes out of the secondary passages 108.

As further shown in FIG. 2, each of the secondary passages 108 define a secondary axis 120 not parallel to the primary axis 102 and directed at a corresponding standoff 112. Each of the secondary passages 108 are positioned radially outward from an outer surface 114 of the nozzle housing 116. The outer surface 114 of the housing 116 defines multiple outer diameters (D1, D2, D3 and D4) which decrease a function of a point along the primary axis 102. A distance L1 between each of the standoffs 108 is greater than a diameter D4 of each of the standoffs 112. The relationship allows for further control of the swirl and exit angle of the mixed fluid.

Figure 3:
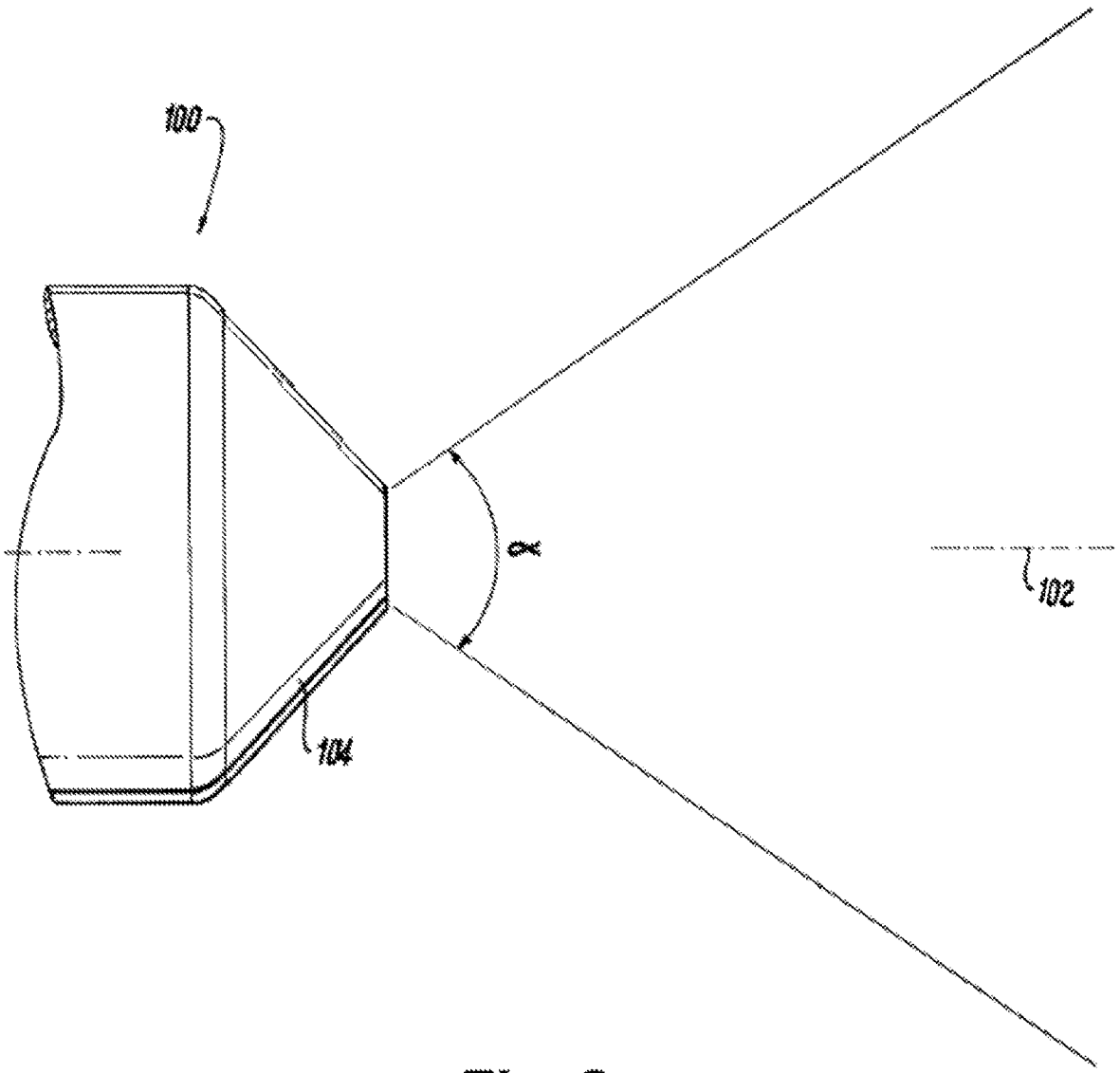
FIG. 3 is a perspective view of the nozzle tip of FIG. 1, showing a flow pattern created by the nozzle assembly.

A method of spraying a fluid, includes feeding a stream through a primary passage 106 of a nozzle along a primary axis 102, producing a swirling fluid stream 108 along a secondary axis 120, at an angle to the primary axis, and reducing the swirl of the fluid by impinging the fluid against a series of standoffs 112 downstream of the secondary passages 108 and exiting nozzle thru annulus 104 at D1, producing a spray as shown in FIG. 3. The spray allows at least an 80 degree angle and no greater than 110 degrees.

The methods and systems of the present disclosure, as described above and shown in the drawings, provide for a nozzle assembly with superior properties including increased spray control. While the apparatus and methods of the subject disclosure have been showing and described with reference to embodiments, those skilled in the art will readily appreciate that changes and/or modifications may be made thereto without departing from the spirit and score of the subject disclosure.

What is claimed is:

1. A spray nozzle comprising:

a housing including a primary passage defining a primary axis;

a series of secondary passages configured to provide swirl to a fluid passing therethrough, circumferentially positioned around the housing; and a series of standoffs circumferentially spread around an outer surface of the housing and located downstream along the primary axis of the series of swirling passages, wherein each of the swirling passages corresponds to a respective standoff of the series of standoffs, in order to control the swirl of the fluid, wherein each of the standoffs is circular.

2. The nozzle of claim 1, wherein each of the standoffs include a rounded face facing the corresponding secondary passage.

3. The nozzle of claim 1, wherein each of the secondary passages defines a secondary axis not parallel to the primary axis.

4. The nozzle of claim 3, wherein each secondary axis is directed at a corresponding standoff.

5. The nozzle of claim 1, wherein the series of secondary passages are positioned radially outward from the outer surface of the housing.

6. The nozzle of claim 1, wherein the standoffs are positioned downstream of the series of secondary passages along the primary axis of the primary passage.

7. The nozzle of claim 1, wherein the outer surface of the housing defines multiple outer diameters as a function of position along the primary axis.

8. A spray nozzle comprising:

a housing including a primary passage defining a primary axis;

a series of secondary passages configured to provide swirl to a fluid passing therethrough, circumferentially positioned around the housing; and a series of standoffs circumferentially spread around an outer surface of the housing and located downstream along the primary axis of the series of swirling passages, wherein each of the swirling passages corresponds to a respective standoff of the series of standoffs, in order to control the swirl of the fluid, wherein a distance between each of the standoffs is greater than a diameter of each of the standoffs.

9. The nozzle of claim 1, wherein the housing is annular.

10. The nozzle of claim 1, further comprising an outer sleeve covering the nozzle.

11. The nozzle of claim 10, wherein a top surface of each of the standoffs is flush against an inner surface of the outer sleeve.

12. The nozzle assembly of claim 11, wherein a flow path is provided between the outer surface of the nozzle and the inner surface of the sleeve, for receiving fluid exiting the secondary passages.

13. A method of spraying a fluid comprising the steps of:

feeding a fluid stream through a primary passage of a nozzle along a primary axis;

producing a swirling fluid stream through a series of secondary passages along a secondary axis, at a non-parallel angle to the primary axis; and reducing the swirl of the fluid by impinging the fluid against a series of standoffs downstream of the secondary passages, wherein each of the standoffs is circular, wherein a distance between each of the standoffs is greater than a diameter of each of the standoffs.

14. The method of claim 13, wherein the spray includes at least an 80 degree angle.

15. The method of claim 14, wherein the spray includes an angle no greater than 110 degrees.

* * * * *